US007144051B2

(12) United States Patent
Gillingham et al.

(10) Patent No.: US 7,144,051 B2
(45) Date of Patent: Dec. 5, 2006

(54) METHOD AND APPARATUS FOR PROVIDING FOR FAIL SAFE CONDITION FOR AN AUTOMATIC SECURITY GATE

(75) Inventors: James R. Gillingham, Costa Mesa, CA (US); Walter Parsadayan, LakeForest, CA (US)

(73) Assignee: The Chamberlain Group, Inc., Elmhurst, IL (US)

( * ) Notice: Subject to any disclaimer, the term of this patent is extended or adjusted under 35 U.S.C. 154(b) by 1043 days.

(21) Appl. No.: 09/928,037

(22) Filed: Aug. 8, 2001

(65) Prior Publication Data

US 2003/0029266 A1 Feb. 13, 2003

(51) Int. Cl.
*E05C 1/06* (2006.01)

(52) U.S. Cl. ..... 292/144; 292/138; 292/150; 70/287.7; 74/609; 160/8

(58) Field of Classification Search ..... 292/144, 292/32, 138, 150, 201, 287.7, 283, 359; 70/287.7, 283, 277, 278.7; 49/138–140, 49/199, 322; 160/8; 74/411.5, 527, 530, 74/625, 608, 609
See application file for complete search history.

(56) References Cited

U.S. PATENT DOCUMENTS 1,323,007 A * 11/1919 Brunette ..... 160/290.1
2,910,859 A * 11/1959 Allen et al. ..... 70/135
3,371,628 A * 3/1968 McClellan ..... 109/59 R
4,129,019 A * 12/1978 Urdal ..... 70/107
4,276,760 A * 7/1981 Nolin ..... 70/107
4,288,944 A * 9/1981 Donovan ..... 49/395
4,390,197 A * 6/1983 Butts ..... 292/144
4,679,415 A * 7/1987 Spratt ..... 70/118
4,691,542 A * 9/1987 Young ..... 70/129
4,784,415 A * 11/1988 Malaval ..... 292/144
4,838,053 A * 6/1989 Shen ..... 70/92
4,979,767 A * 12/1990 Lin ..... 292/336.3
4,995,248 A * 2/1991 Liu ..... 70/107
5,134,870 A * 8/1992 Uyeda et al. ..... 70/277
5,245,846 A * 9/1993 James ..... 70/118
5,253,693 A * 10/1993 Marlatt et al. ..... 160/7
5,263,347 A * 11/1993 Allbaugh et al. ..... 70/257
5,474,348 A * 12/1995 Palmer et al. ..... 292/359
5,482,103 A * 1/1996 Burgess et al. ..... 160/9
5,487,289 A * 1/1996 Otto et al. ..... 70/279.1
5,492,380 A * 2/1996 Smallegan et al. ..... 292/336.3
5,588,318 A * 12/1996 Osborne ..... 70/469
5,658,026 A * 8/1997 Nigro et al. ..... 292/336.3

(Continued)

*Primary Examiner*—Brian E. Glessner
*Assistant Examiner*—Carlos Lugo
(74) *Attorney, Agent, or Firm*—Fitch, Even, Tabin & Flannery

(57) ABSTRACT

A method and apparatus for locking a security gate operating shaft contained in a security gate operating mechanism having a housing from which extends the operating shaft, which may comprise: a locking collar, having at least one engageable protrusion extending radially, mounted on the operating shaft for rotary motion with it; an operating shaft locking mechanism slide mounting assembly attachable to the housing in one of at least two positions; a locking plate slideably mounted in the slide mounting and having an opening in registration with the operating shaft with at least one locking finger extending into the opening and adapted to engage at least one engageable protrusion; an electrically operated sliding unit adapted, when energized to move the slideable plate to one position against gravity, when deenergized to allow the slideable plate to move with gravity to a second position.

47 Claims, 4 Drawing Sheets

U.S. PATENT DOCUMENTS 5,881,586 A * 3/1999 Shen ..... 70/107
6,094,953 A * 8/2000 Evans ..... 70/278.1
6,128,933 A * 10/2000 Mirshafiee et al. ..... 70/107
6,170,305 B1 * 1/2001 Shen ..... 70/107
6,401,792 B1 * 6/2002 Mullet et al. ..... 160/188
6,412,320 B1 * 7/2002 Maniago ..... 70/277
6,527,037 B1 * 3/2003 Daus et al. ..... 160/315
6,615,629 B1 * 9/2003 Bates et al. ..... 70/434

* cited by examiner

NORMALLY UNLOCKED
POWER ON
LOCK ENGAGED

LOCK OFF

UNLOCK ON

LOCKED DURING POWER FAILURE

UNLOCK OFF

LOCK ON

UNLOCKED DURING POWER FAILURE

METHOD AND APPARATUS FOR PROVIDING FOR FAIL SAFE CONDITION FOR AN AUTOMATIC SECURITY GATE

FIELD OF THE INVENTION

The present invention relates to the field of automatically controlled security gates and specifically ones which are automatically motor driven.

BACKGROUND OF THE INVENTION

Automatically motor driven security gates operated by the approach of, e.g., a vehicle, e.g., with the detection of the presence of the vehicle, or with some coded operating mechanism, e.g., a sound operated or infrared operated coded signaling device are well known in the art. Such gates are very secure and also very convenient, and have the advantage of not having to be personed, i.e., have a gate operator that activates the gate upon the approach of a vehicle authorized to pass through the gage, in ingress or egress. This can also, however, be a disadvantage in the event, e.g., of a power failure. In such cases, especially where the power failure occurs with the gate in an intermediate position between fully open or fully closed, the gate could be desired to be able to be moved from the intermediate position or be desired to be kept in the intermediate position pending the return of power to the gate operating mechanism. A simple and convenient way of accomplishing this goal is needed. The present invention is a way of satisfying that need.

SUMMARY OF THE INVENTION

A method and apparatus for locking a gate operating shaft contained in a security gate operating mechanism having a housing from which extends the operating shaft, is disclosed, which may comprise: a locking collar mounted on the operating shaft for rotary motion along with the operating shaft, and having at least one engageable protrusion extending radially from the locking collar; an operating shaft locking mechanism slide mounting assembly attachable to the housing in one of at least two positions; a locking plate slideably mounted in the slide mounting and having an opening in registration with the operating shaft and having at least one locking finger extending into the opening and adapted to engage the at least one engageable protrusion; an electrically operated sliding unit adapted, when energized, to move the slideable plate to a first position against the force of gravity, and when deenergized to allow the slideable plate to move with the force of gravity to a second position; and, wherein the mounting of the slide mounting assembly in the first position of the slide mounting assembly places the at least one locking finger in a position to engage the at least one engageable protrusion when the electrically operated sliding unit is deenergized and the mounting of the slide mounting assembly in the second position of the slide mounting assembly places the at least one locking finger in a position to engage the at least one engageable protrusion when the electrically operated sliding unit is energized. The at lease one locking finger may comprise a first and a second locking finger, and wherein in the first mounting position of the slide mounting assembly the first locking finger is in the engaging position when the electrically operated sliding unit is deenergized and wherein in the second mounting of the slide mounting assembly the second locking finger is in the engaging position when the electrically operated sliding unit is energized. The locking collar may includes a plurality of engageable protrusions and the electrically operated sliding unit may comprise a solenoid operated arm connected to the locking plate. The locking collar may comprise a sprocket wheel having a plurality of radially extending sprocket teeth. The electrically operated sliding unit may be electrically connected to a power source that is also electrically connected to the source of electrical power for operating the operating shaft and the first mounting position of the slide mounting assembly is a fail-locked position, or the electrically operated sliding unit may be electrically connected to a power source that is also electrically connected to the source of electrical power for operating the operating shaft and the first mounting position of the slide mounting assembly is a fail-locked position.

DETAILED DESCRIPTION OF THE PREFERRED EMBODIMENTS

Figure 1:
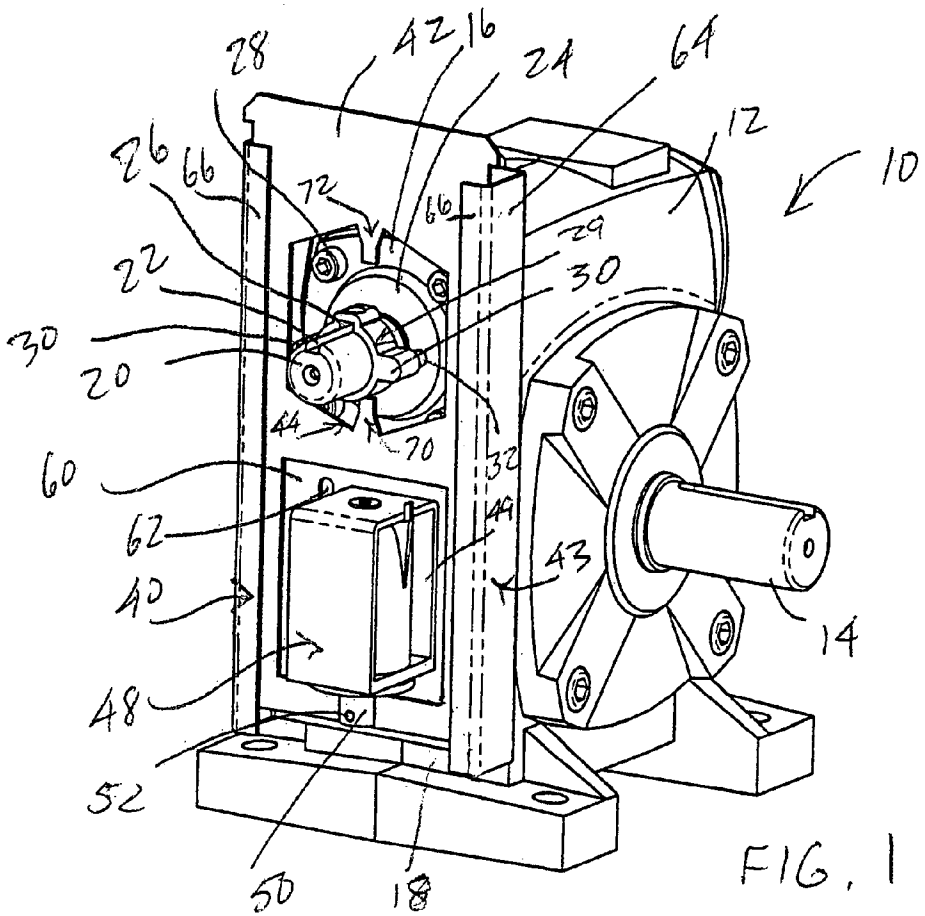
FIG. 1 shows a perspective view of a gate operating mechanism driving member according to an embodiment of the present invention.

Turning now to FIG. 1 there is shown a perspective view of an embodiment of the present invention. This embodiment may include a motorized security gate operating system 10, in the case of FIG. 1, only a portion of the security gate operating mechanism need be illustrated to exemplify the present invention, e.g., the reduction gear that reduces the speed provided on an input shaft 14 from a drive motor (not shown) to provide on an output shaft 20 a number of RPM of from, e.g., 1 or 2 RPM to 10–20 RPM, depending upon the type of motorized security gate being operated. It will be understood by those in the art that the present invention may be used with, e.g., a chain driven sliding gate system, wherein the gate slides back and forth, e.g., on a track and the drive shaft is, e.g., fitted with a chain drive sprocket. In this event the higher range of RPM may typically be used. Alternatively, e.g., the security gate system may be a swinging gate system, in which event, the output drive shaft may be directly connected to, e.g., one arm of a pivoted arm driving mechanism and the lower range of RPM could be more appropriate.

The security gate driving mechanism 10 may have a housing 12 which may have a side wall 18. The side wall 18 may also include an output shaft mounting plate 16 mounted to the housing by mounting nuts 28. The mounting plate 16 may have a generally circular raised surface 24 surrounding an opening in the mounting plate 16 for the drive shaft 20.

The drive shaft 20 may also have a key way groove 22, as is well known. According to the present invention there may be attached to the drive shaft 20 a locking collar 29, which may also have a key way groove 26. The locking collar 29 may be attached for rotary movement with the output drive shaft 20 with a threaded key as is well known, e.g., for connecting a rotating pulley to such an output operating shaft 20. The locking collar may have a plurality of engageable protrusions 30. The engageable protrusions may rest essentially flush against the raised surface 24, or, as illustrated in FIG. 1 may bed further supported and held in position during engagement by posts 32. The posts 32 will be understood to be possibly mounted on the locking collar 29, extending, e.g., from the protrusions 30 and engaging holes formed in the raised surface 24, or, alternatively may be extensions mounted on the upraised surface and extending into holes (not shown) formed in the protrusions 30.

Also attached to the housing of the security gate drive mechanism 10 on the side wall 18 may be a locking mechanism slide mounting assembly 40. The slideable mounting assembly 40 may include a slideable plate 42 and a mounting frame 43. The mounting frame 43 may have a back wall 60, a pair of side walls 64 and a pair of front flanges 66 extending from each of the respective side walls 64 generally parallel to the plane of the rear wall 60. Contained in the rear wall 60 may be at least one adjustable mounting slot 62. The adjustable mounting slot 62 may serve to enable the positioning of the slideable mounting assembly 40 with respect to the position of the output drive shaft 20 as more fully described below. It will be understood that this function may be performed, as illustrated in FIG. 1, with the slot 62 receiving a bolt member extending outwardly from the drive mechanism side wall 18 or for aligning a bolt with a receiving hole in the side wall 18 or the like, such that the slideable mounting assembly 40 may be selectively placed in, e.g., one of a pair of first and second selectable positions relative to the output operating shaft 20.

Figures 2A, 2B:
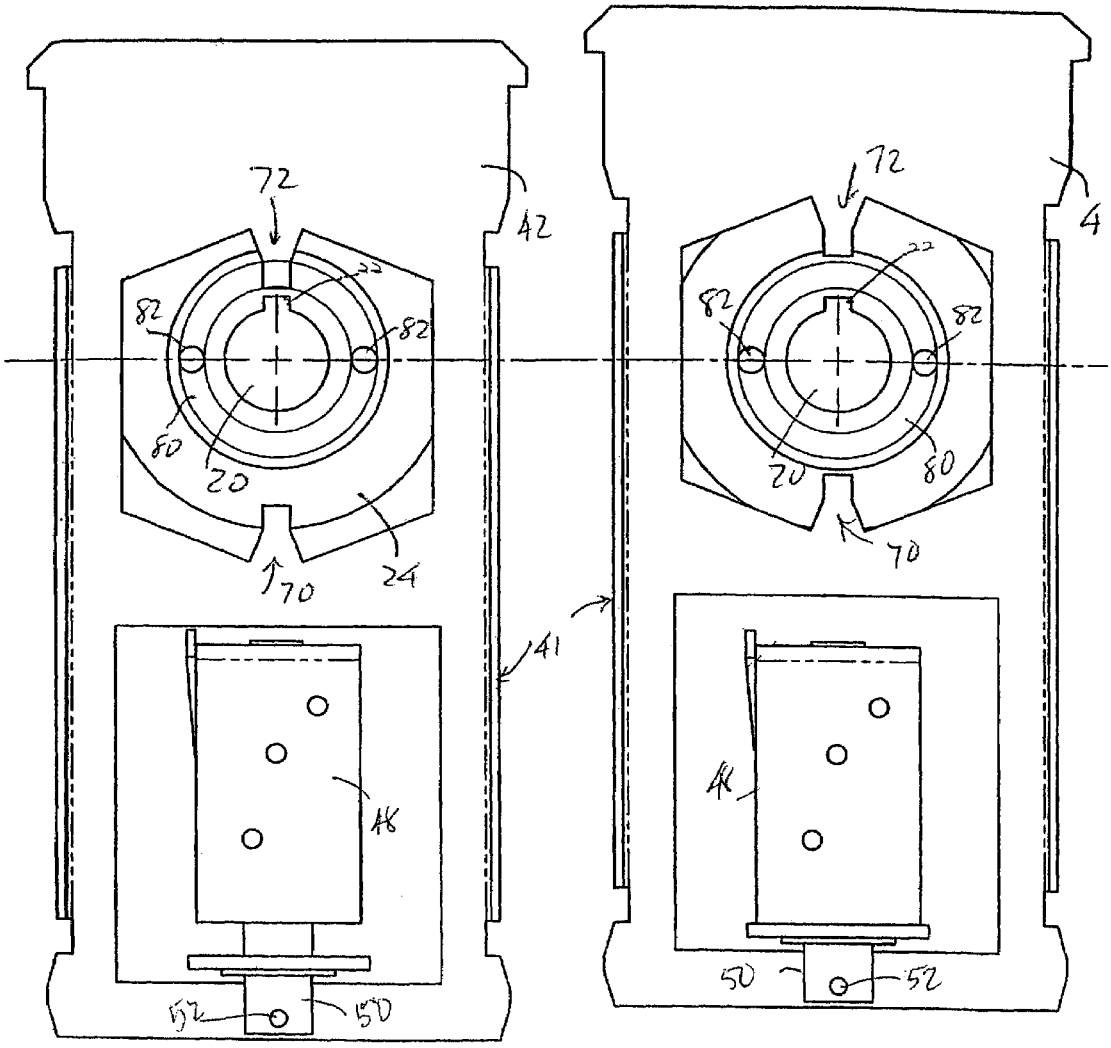
FIGS. 2(*a*), 2(*b*), 2(*c*) and 2(*d*) show side views of an embodiment of the present invention in several operating positions of the present invention; and, FIG. 3 shows another example of an engaging member according to another embodiment of the present invention.
Figures 2C, 2D:
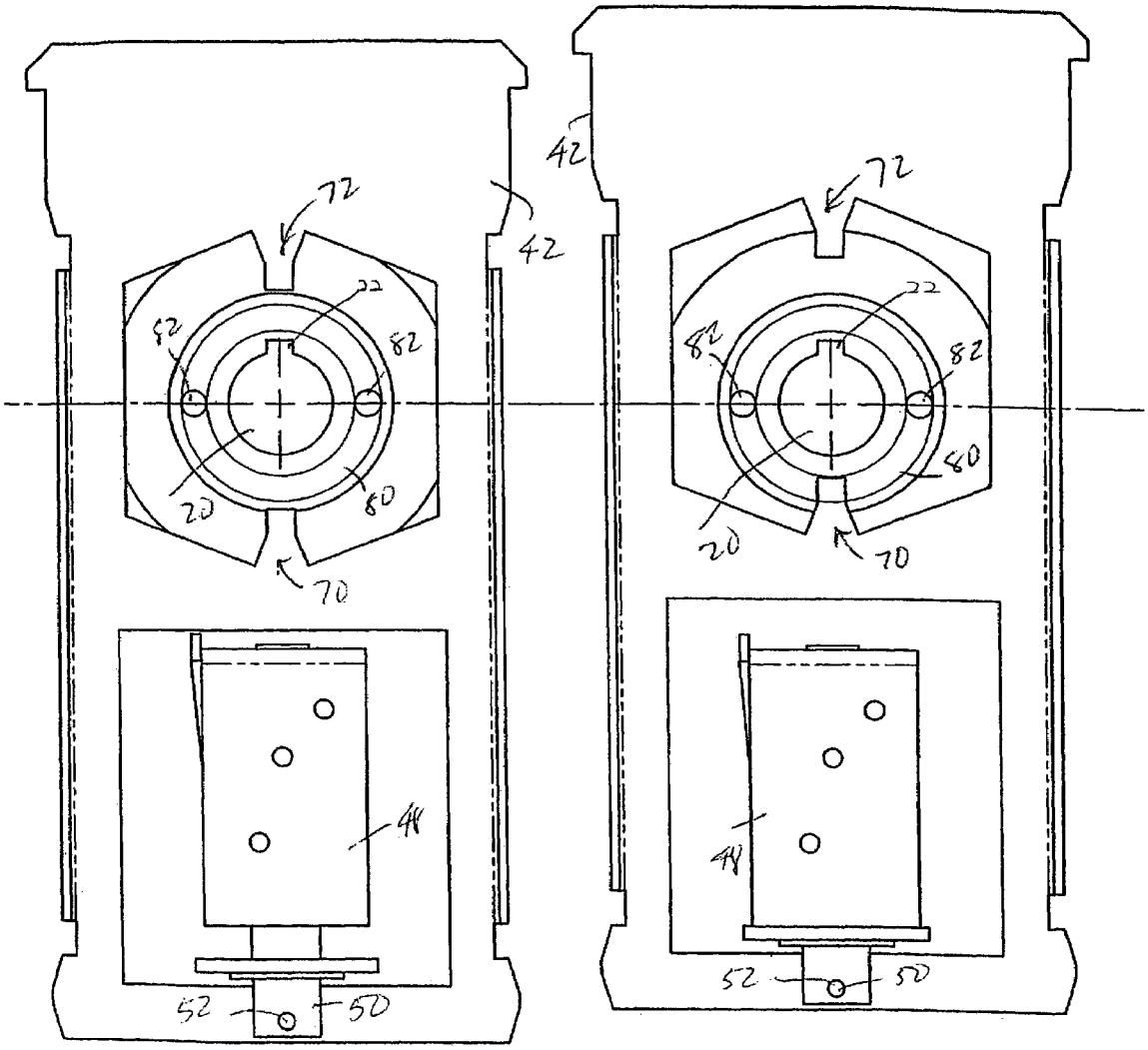
Figure 3:
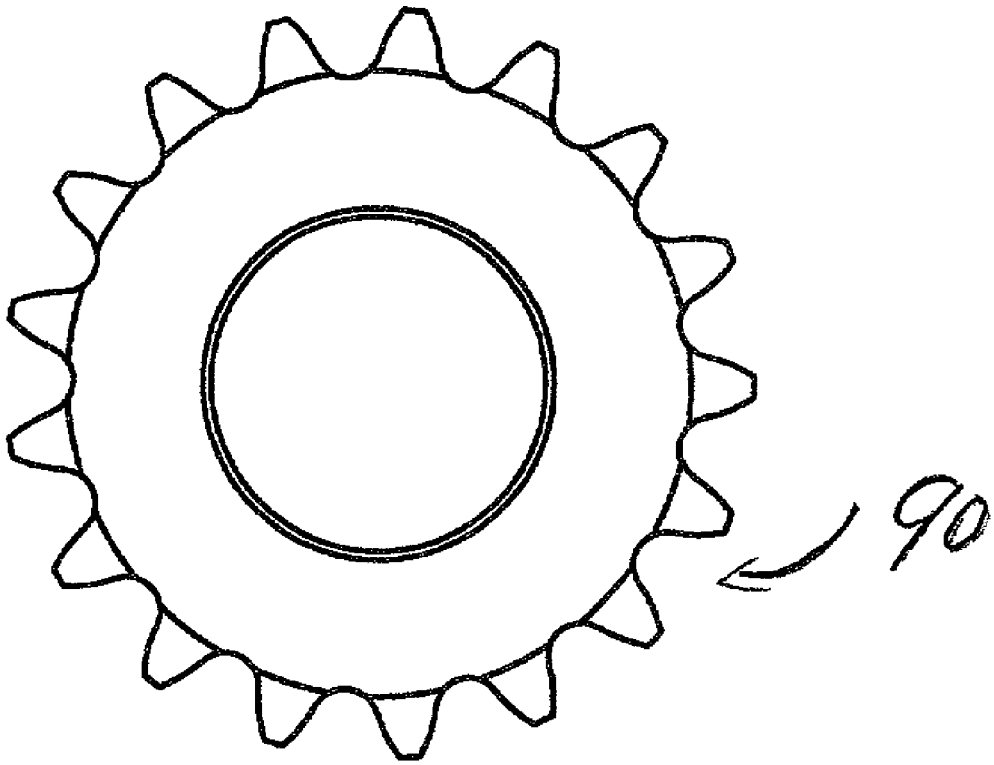

Mounted within the slideable mounting assembly 40 can be a slideable locking plate 42. The slideable locking plate 42 may have an opening 44 in general registration with the operating shaft 20. Extending into the opening 44 in generally the axis of slideable movement of the slideable locking plate 42 within the slideable mounting assembly 40 may be a pair of locking fingers 70, 72. Attached to the slideable locking plate 42 by means of, e.g., a slotted operating arm 50 and an attachment pin 52 can be an electrically operated sliding mechanism, which as illustrated can be a solenoid 48. The solenoid 48 may be attached to the back plate 60 of the slideable mounting assembly 40 by a solenoid housing 49. As shown in FIG. 1, the slideable locking plate may have side walls of its own (not shown in FIG. 1) extending toward the back plate 60 of the slideable mounting assembly 40, such that the slideable locking plate is in sliding contact with the front flanges 66 of the slideable mounting assembly 40. In this event, the locking fingers 70, 72, respectively, and as explained in more detail below, may engage the protrusions 30 of the locking collar 29. Alternatively, as shown in FIGS. 2(*a*)–(*d*) the side walls 41 may extend in the opposite direction, such that the slideable locking plate is essentially in sliding contact with the raised surface 24. In this embodiment, the fingers 70, 72, when in engagement may engage, e.g., the posts 32 as shown in FIG. 1.

Turning now to FIGS. 2(*a*)–2(*d*), there is shown an embodiment of the present invention illustrating the operation of the slideable locking plate 42 according to the present invention. In this embodiment of the present invention the locking collar has been replaced with a locking pulley 80 into the pulley slot of which can be mounted, e.g., as by welding, engaging pins 82, which can act as the engaging protrusions or the engaging posts as explained above in regard to FIG. 1.

In operation, the present invention can be utilized in the following manner. The slideable locking plate 42 of the slideable mounting assembly 40 can be positioned as shown in FIG. 2(*a*), with the solenoid 48 deenergized, i.e., disengaged, the slideable locking plate, e.g., under the influence of gravity has moved to a position where the locking finger 72 is positioned to engage the locking pins 82, shown in FIGS. 2(*a*) and 2(*b*), or the engaging protrusions 30 or posts 32, as explained above in regard to FIG. 1. Alternatively, with the solenoid 48 energized, i.e., engaged, as shown in FIG. 2(*b*) for the first selected position of the slideable mounting assembly 40, neither of the fingers 70, 72 is in a position for engaging the locking collar protrusions 30 or posts 32 of FIG. 1, or the engaging pins 82 of FIG. 2(*a*) or (*b*). In this first selectable position of the slideable mounting assembly 40, therefore, the security gate is in a fail locked position. In such an embodiment of the present invention the solenoid 48 and the motor (not shown) for the security gate operating mechanism 10 may be connected to the same electrical power source, such that failure of power to the motor (not shown) results in the security gate locking mechanism 10 being locked in a position by the locking finger 72 preventing further rotation of the operating shaft 20.

In a second selected position of the slideable locking plate 42 of the slideable mounting assembly 40, with the solenoid 48 in the deenergized, i.e., disengaged position, the locking fingers may be in essentially the same position as shown in FIG. 2(*b*), i.e., neither being in engagement with the locking collar 29 of locking pulley 80. However, with the solenoid 48 engaged, as illustrated in FIG. 2(*d*), the locking finger 70 can be in position to engage the engaging pins 82, as shown in FIG. 2(*d*) or the engaging protrusions 30 or posts 32 as shown in FIG. 1. In this embodiment, the present invention forms a fail unlocked mode. It will also be understood that the motor (not shown) and the solenoid 48 in this embodiment must be on a separate power supply and the solenoid may be activated or energized independently of whether there exists power to the motor, when it may be desired to prevent movement of the security gate by placing the locking finger 70 in the position of FIG. 2(*d*) to engage the engaging pins 82 of FIGS. 2(*a*)–2(*d*) or the engaging protrusions 30 or posts 32 of FIG. 1.

The present invention has been described through an illustrative presently preferred embodiment and should not be limited to the preferred embodiment. Other embodiments of the present invention can be appreciated by those skilled in the art, e.g., the sliding plate can be spring loaded to the deenergized position, and gravity, thus need not be the returning force, leaving, e.g., the sliding plate to have other axes of sliding movement other than vertical. These and other modifications could be made without departing from the scope of the present invention, as reflected in the appended claims.

We claim:

1. A locking mechanism for a security gate operating shaft contained in a security gate operating mechanism having a housing from which extends the operating shaft, comprising:

a locking collar adapted to be mounted on the operating shaft for rotary motion along with the operating shaft, and having at least one engageable member;

an operating shaft locking mechanism slide mounting assembly attachable to the housing in one of at least two positions;

a locking plate slideably mounted in the slide mounting assembly and having an opening in registration with the operating shaft and having at least one locking finger extending into the opening and adapted to engage the at least one engageable member;

an electrically operated sliding unit adapted, when energized, to move the slideable plate to a first position against a return force, and when deenergized to allow the slideable plate to move under the influence of the return force to a second position; and, wherein the mounting of the locking plate in the first position of the slide mounting assembly places the at least one locking finger in a position to engage the at least one engageable member when the electrically operated sliding unit is deenergized and the mounting of the locking plate in the second position of the slide mounting assembly places the at least one locking finger in a position to engage the at least one engageable member when the electrically operated sliding unit is energized.

2. The apparatus of claim 1 wherein the at least one locking finger comprises a first locking finger and a second locking finger, and wherein in the first mounting position of the slide mounting assembly the first locking finger is in an engaging position when the electrically operated sliding unit is deenergized and wherein in the second mounting position of the slide mounting assembly the second locking finger is in an engaging position when the electrically operated sliding unit is energized.

3. The apparatus of claim 1 further comprising:

the locking collar includes a plurality of engageable members.

4. The apparatus of claim 2 further comprising:

the locking collar includes a plurality of engageable members.

5. The apparatus of claim 1 further comprising:

the electrically operated sliding unit comprises a solenoid operated arm connected to the locking plate.

6. The apparatus of claim 2 further comprising:

the electrically operated sliding unit comprises a solenoid operated arm connected to the locking plate.

7. The apparatus of claim 3 further comprising:

the locking collar comprises a sprocket wheel having a plurality of radially extending sprocket teeth.

8. The apparatus of claim 4 further comprising:

the locking collar comprises a sprocket wheel having a plurality of radially extending sprocket teeth.

9. The apparatus of claim 5 further comprising:

the locking collar comprises a sprocket wheel having a plurality of radially extending sprocket teeth.

10. The apparatus of claim 6 further comprising:

the locking collar comprises a sprocket wheel having a plurality of radially extending sprocket teeth.

11. The apparatus of claim 1 further comprising:

the electrically operated sliding unit is electrically connected to a power source that is also electrically connected to the source of electrical power for operating the operating shaft and the first mounting position of the slide mounting assembly is a fail-locked position.

12. The apparatus of claim 2 further comprising:

the electrically operated sliding unit is electrically connected to a power source that is also electrically connected to the source of electrical power for operating the operating shaft and the first mounting position of the slide mounting assembly is a failed locked position.

13. The apparatus of claim 1 further comprising:

the electrically operated sliding unit is electrically connected to a power source other than that which is electrically connected to the source of electrical power for operating the operating shaft and the second mounting position of the slide mounting assembly is a fail-unlocked position.

14. The apparatus of claim 2 further comprising:

the electrically operated sliding unit is electrically connected to a power source that is also electrically connected to the source of electrical power for operating the operating shaft and the second mounting position of the slide mounting assembly is a fail-unlocked position.

15. A locking mechanism for a security gate operating shaft contained in a security gate operating mechanism having a housing from which extends the operating shaft, comprising:

a locking collar adapted to be mounted on the operating shaft for rotary motion along with the operating shaft, and having at least one engageable protrusion extending radially from the locking collar;

an operating shaft locking mechanism slide mounting assembly attachable to the housing in one of at least two positions;

a locking plate slideably mounted in the slide mounting and having an opening in registration with the operating shaft and having at least one locking finger extending into the opening and adapted to engage the at least one engageable protrusion;

sliding means for moving the slideable plate to a first position against a return force when energized, and when deenergized for allowing the slideable plate to move in response to the return force to a second position; and, wherein the mounting of the locking plate in the first position of the slide mounting assembly places the at least one locking finger in a position to engage the at least one engageable protrusion when the electrically operated sliding unit is deenergized and the mounting of the locking plate in the second position of the slide mounting assembly places the at least one locking finger in a position to engage the at least one engageable protrusion when the electrically operated sliding unit is energized.

16. The apparatus of claim 15 wherein the at least one locking finger comprises a first locking finger and a second locking finger, and wherein in the first mounting position of the slide mounting assembly the first locking finger is in the engaging position when the sliding means is deenergized and wherein in the second mounting of the slide mounting assembly the second locking finger is in the engaging position when the sliding means is energized.

17. The apparatus of claim 15 further comprising:

the locking collar includes a plurality of engageable protrusions.

18. The apparatus of claim 16 further comprising:

the locking collar includes a plurality of engageable protrusions.

19. The apparatus of claim 15 further comprising:

the sliding means comprises a solenoid operated arm connected to the locking plate.

20. The apparatus of claim 16 further comprising:

the sliding means comprises a solenoid operated arm connected to the locking plate.

21. The apparatus of claim 17 further comprising:

the locking collar comprises a sprocket wheel having a plurality of radially extending sprocket teeth.

22. The apparatus of claim 18 further comprising:

the locking collar comprises a sprocket wheel having a plurality of radially extending sprocket teeth.

23. The apparatus of claim 19 further comprising:

the locking collar comprises a sprocket wheel having a plurality of radially extending sprocket teeth.

24. The apparatus of claim 20 further comprising:

the locking collar comprises a sprocket wheel having a plurality of radially extending sprocket teeth.

25. The apparatus of claim 15 further comprising:

the sliding means in the first mounting position of the slide mounting assembly comprises a means for failing-locked.

26. The apparatus of claim 16 further comprising:

the sliding means in the first mounting position of the slide mounting assembly comprises a means for failing-locked.

27. The apparatus of claim 15 further comprising:

the sliding means in the second mounting position of the slide mounting assembly comprises a means for failing-unlocked.

28. The apparatus of claim 16 further comprising:

the sliding means in the second mounting position of the slide mounting assembly comprises a means for failing-unlocked.

29. A method for locking a security gate operating shaft contained in a security gate operating mechanism having a housing from which extends the operating shaft, comprising:

including a locking collar on the operating shaft for rotary motion along with the operating shaft, the locking collar having at least one engageable protrusion extending radially from the locking collar;

providing an operating shaft locking mechanism slide mounting assembly attachable to the housing in one of at least two positions;

slideably mounting a slidable locking plate in the slide mounting assembly, the locking plate having an opening in registration with the operating shaft and having at least one locking finger extending into the opening and adapted to engage the at least one engageable protrusion;

moving the slideable locking plate to a first selectable position against a return force or allowing the slideable locking plate to move in response to the return force to a second selectable position; and, wherein the mounting of the locking plate in the first position of the slide mounting assembly places the at least one locking finger in a position to engage the at least one engageable protrusion when in the first selectable position and the mounting of the locking plate in the second position of the slide mounting assembly places the at least one locking finger in a position to engage the at least one engageable protrusion when in the second selectable position.

30. The method of claim 29 wherein the at least one locking finger comprises a first locking finger and a second locking finger, and wherein in the first mounting position of the slide mounting assembly the first locking finger is in the engaging position in the first selectable position and wherein in the second mounting of the slide mounting assembly the second locking finger is in the engaging position in the second selectable position.

31. The method of claim 29 further comprising:

the locking collar includes a plurality of engageable protrusions.

32. The method of claim 30 further comprising:

the locking collar includes a plurality of engageable protrusions.

33. The method of claim 29 further comprising:

utilizing a solenoid operated mechanism to select between the first and second selectable positions.

34. The method of claim 30 further comprising:

utilizing a solenoid operated mechanism to select between the first and second selectable positions.

35. The method of claim 31 further comprising:

the locking collar comprises a sprocket wheel having a plurality of radially extending sprocket teeth.

36. The method of claim 32 further comprising:

the locking collar comprises a sprocket wheel having a plurality of radially extending sprocket teeth.

37. The method of claim 33 further comprising:

the locking collar comprises a sprocket wheel having a plurality of radially extending sprocket teeth.

38. The method of claim 34 further comprising:

the locking collar comprises a sprocket wheel having a plurality of radially extending sprocket teeth.

39. The method of claim 29 further comprising:

in the first mounting position of the slide mounting assembly the first selectable position comprises a fail-locked position.

40. The method of claim 30 further comprising:

in the first mounting position of the slide mounting assembly the first selectable position comprises a fail-locked position.

41. The method of claim 29 further comprising:

in the second mounting position of the slide mounting assembly the first selectable position comprises a fail-unlocked position.

42. The method of claim 30 further comprising:

in the second mounting position of the slide mounting assembly the first selectable position comprises a fail-unlocked position.

43. A locking mechanism for a security gate operating shaft contained in a security gate operating mechanism having a housing from which extends the operating shaft, comprising:

a locking collar adapted to be mounted on the operating shaft for rotary motion along with the operating shaft, and having at least one engageable protrusion extending radially from the locking collar;

an operating shaft locking mechanism slide mounting assembly attachable to the housing in one of at least two positions;

a locking plate slideably mounted in the slide mounting and having an opening in registration with the operating shaft and having at least one locking finger extending into the opening and adapted to engage the at least one engageable protrusion;

an electrically operated sliding unit adapted, when energized, to move the slideable plate to a first position against a return force, and when deenergized to allow the slideable plate to move in response to the return force to a second position;

wherein the mounting of the locking plate in the first position of the slide mounting assembly places the at least one locking finger in a position to engage the at least one engageable protrusion when the electrically operated sliding unit is deenergized and the mounting of the locking plate in the second position of the slide mounting assembly places the at least one locking finger in a position to engage the at least one engageable protrusion when the electrically operated sliding unit is energized; and, wherein the at least one locking finger comprises a first locking finger and a second locking finger, and wherein in the first mounting position of the slide mounting assembly the first locking finger is in the engaging position when the electrically operated sliding unit is deenergized and wherein in the second mounting of the slide mounting assembly the second locking finger is in the engaging position when the electrically operated sliding unit is energized.

44. A locking mechanism for a security gate operating shaft contained in a security gate operating mechanism having a housing from which extends the operating shaft, comprising:

a locking collar adapted to be mounted on the operating shaft for rotary motion along with the operating shaft, and having a plurality of engageable protrusions extending radially from the locking collar;

an operating shaft locking mechanism slide mounting assembly attachable to the housing in one of at least two positions;

a locking plate slideably mounted in the slide mounting and having an opening in registration with the operating shaft and having at least one locking finger extending into the opening and adapted to engage the plurality of engageable protrusions;

an electrically operated sliding unit adapted, when energized, to move the slideable plate to a first position against a return force, and when deenergized to allow the slideable plate to move in response to the return force to a second position;

wherein the mounting of the locking plate in the first position of the slide mounting assembly places the at least one locking finger in a position to engage the at least one engageable protrusion when the electrically operated sliding unit is deenergized and the mounting of the locking plate in the second position of the slide mounting assembly places the at least one locking finger in a position to engage the plurality of engageable protrusions when the electrically operated sliding unit is energized; and wherein the at least one locking finger comprises a first locking and a second locking finger, and wherein in the first mounting position of the slide mounting assembly the first locking finger is in the engaging position when the electrically operated sliding unit is deenergized and wherein in the second mounting of the slide mounting assembly the second locking finger is in the engaging position when the electrically operated sliding unit is energized.

45. A locking mechanism for a security gate operating shaft contained in a security gate operating mechanism having a housing from which extends the operating shaft, comprising:

a locking collar adapted to be mounted on the operating shaft for rotary motion along with the operating shaft, and having a plurality of engageable protrusions extending radially from the locking collar;

an operating shaft locking mechanism slide mounting assembly attachable to the housing in one of at least two positions;

a locking plate slideably mounted in the slide mounting and having an opening in registration with the operating shaft and having at least one locking finger extending into the opening and adapted to engage the plurality of engageable protrusions;

an electrically operated sliding unit adapted, when energized, to move the slideable plate to a first position against a return force, and when deenergized to allow the slideable plate to move in response to the return force to a second position;

wherein the mounting of the locking plate in the first position of the slide mounting assembly places the at least one locking finger in a position to engage the plurality of engageable protrusions when the electrically operated sliding unit is deenergized and the mounting of the locking plate in the second position of the slide mounting assembly places the at least one locking finger in a position to engage the plurality of engageable protrusions when the electrically operated sliding unit is energized;

wherein the at least one locking finger comprises a first locking finger and a second locking finger, and wherein in the first mounting position of the slide mounting assembly the first locking finger is in the engaging position when the electrically operated sliding unit is deenergized and wherein in the second mounting of the slide mounting assembly the second locking finger is in the engaging position when the electrically operated sliding unit is energized; and, the electrically operated sliding unit comprises a solenoid operated arm connected to the locking plate.

46. A locking mechanism for a security gate operating shaft contained in a security gate operating mechanism having a housing from which extends the operating shaft, comprising:

a locking collar adapted to be mounted on the operating shaft for rotary motion along with the operating shaft, and having at least one engageable protrusion extending radially from the locking collar;

an operating shaft locking mechanism slide mounting assembly attachable to the housing in one of at least two positions;

a locking plate slideably mounted in the slide mounting and having an opening in registration with the operating shaft and having at least one locking finger extending into the opening and adapted to engage the at least one engageable protrusion;

an electrically operated sliding unit adapted, when energized, to move the slideable plate to a first position against a return force, and when deenergized to allow the slideable plate to move in response to the return force to a second position;

wherein the mounting of the locking plate in the first position of the slide mounting assembly places the at least one locking finger in a position to engage the at least one engageable protrusion when the electrically operated sliding unit is deenergized and the mounting of the locking plate in the second position of the slide mounting assembly places the at least one locking finger in a position to engage the at least one engageable protrusion when the electrically operated sliding unit is energized;

wherein the at least one locking finger comprises a first locking finger and a second locking finger, and wherein in the first mounting position of the slide mounting assembly the first locking finger is in the engaging position when the electrically operated sliding unit is deenergized and wherein in the second mounting of the slide mounting assembly the second locking finger is in the engaging position when the electrically operated sliding unit is energized;

the locking collar comprises a sprocket wheel having a plurality of radially extending sprocket teeth; and, the electrically operated sliding unit comprises a solenoid operated arm connected to the locking plate.

47. A locking mechanism for a security gate operating shaft contained in a security gate operating mechanism having a housing from which extends the operating shaft, comprising:

a locking collar adapted to be mounted on the operating shaft for rotary motion along with the operating shaft, and having at least one engageable protrusion extending radially from the locking collar;

an operating shaft locking mechanism slide mounting assembly attachable to the housing in one of at least two positions;

a locking plate slideably mounted in the slide mounting and having an opening in registration with the operating shaft and having at least one locking finger extending into the opening and adapted to engage the at least one engageable protrusion;

an electrically operated sliding unit adapted, when energized, to move the slideable plate to a first position against a return force, and when deenergized to allow the slideable plate to move against the return force to a second position;

wherein the mounting of the locking plate in the first position of the slide mounting assembly places the at least one locking finger in a position to engage the at least one engageable protrusion when the electrically operated sliding unit is deenergized and the mounting of the locking plate in the second position of the slide mounting assembly places the at least one locking finger in a position to engage the at least one engageable protrusion when the electrically operated sliding unit is energized; and, the electrically operated sliding unit is electrically connected to a power source that is also electrically connected to the source of electrical power for operating the operating shaft and the first mounting position of the slide mounting assembly is a fail-locked position.

* * * * *